US006347599B1

(12) United States Patent
Hendrickson

(10) Patent No.: US 6,347,599 B1
(45) Date of Patent: Feb. 19, 2002

(54) STABILIZATION/POWER SYSTEM FOR WINDSURFING AND OTHER FLOTATION BOARDS

(76) Inventor: Richard A. Hendrickson, 541 Peeples Dr., Punta Gorda, FL (US) 33950

( * ) Notice: Subject to any disclaimer, the term of this patent is extended or adjusted under 35 U.S.C. 154(b) by 0 days.

(21) Appl. No.: 09/675,663

(22) Filed: Sep. 29, 2000

(51) Int. Cl.[7] ..... B63B 1/20
(52) U.S. Cl. ..... 114/283; 114/123; 441/74
(58) Field of Search ..... 114/283, 123, 114/126, 39.12; 441/74

(56) References Cited

U.S. PATENT DOCUMENTS 4,700,648 A * 10/1987 Trefethern et al. ..... 114/125

FOREIGN PATENT DOCUMENTS

EP 350599 * 5/1989 ..... 114/123

* cited by examiner

*Primary Examiner*—Jesus D. Sotelo
(74) *Attorney, Agent, or Firm*—Frank A. Lukasik

(57) ABSTRACT

This invention relates to stabilization and propulsion of windsurfing and other floating boards such as surf boards. The invention consists of a modular device consisting of a seat and pontoon float unit fitted with remote controls by which a modified trolling motor can be used to steer and propel the board through the water.

1 Claim, 4 Drawing Sheets

STABILIZATION/POWER SYSTEM FOR WINDSURFING AND OTHER FLOTATION BOARDS

BACKGROUND OF THE INVENTION

1. Field of the invention

This invention relates to stabilization and propulsion of windsurfing and other floating boards such as surf boards and more specifically to a modular device comprising a seat and pontoon float unit fitted with remote controls by which a modified trolling motor can be used to steerably propel such boards through the water.

2. History of the Prior Art

In U.S. Pat. No. 5,988,090 Barker Jr. discloses an adjustable pontoon system for attachment to conventional small water craft including canoes, Jon boats, rowboats, dinghies and the like.

Pontoons have been in use for hundreds of years since the time of ancient Polynesian migration across the Pacific. In modern times, craft such as windsurfing boards have relied upon small skeg keels, rapid forward motion and the skill of the rider to maintain an upright position. At slow speeds, surfboards and windsurfing boards are unstable when a rider stands upright. Such boards are not easily propelled without either sails or moving waves. While U.S. Pat. No. 5,988,090 discloses a pontoon system for canoes and small craft, the system is not adaptable to boards such as those used for windsurfing or surfing due to the bulk of the system. The present invention improves upon the above system by converting a floating board of the type described herein into a portable, stable, controllably powered platform suitable for fishing or other pastime.

SUMMARY OF THE INVENTION

A stabilization/seating assembly adapted for use with windsurfing or other floating boards. The assembly includes mounting means by which the controls of a modified trolling motor may be attached adjacent to the seat. The motor portion being rotatably attached to the rear of the board where it can be controlled to steerably propel the board through the water.

The stabilization/seating assembly consisting of a seat and a pair of outrigger floats (pontoons) is removably attached to a suitable floating board. This assembly can be variously attached to boards either by adjustable clamps or by through bolting to the board. A trolling motor which has been modified so as to separate the lower, motor unit, for separate attachment to the rear of the board, is attached with its controls adjacent to the seat. A control rod with universal ball sockets connects the motor unit and the control handle to the mounting and provides the remote means by which the craft can be controlled. The addition of the control rod and the use of the mounting bracket for the upper half of the trolling motor facilitates the turning of the lower motor unit in either direction for steering. The electrical cable connecting the twist grip speed control, the battery and the trolling motor is attached to the control rod for stability. The cable from an existing trolling motor which is modified as described above, can be extended as necessary to reach from the twist grip located adjacent to the seat and the electric trolling motor itself.

It is the primary object of the present invention to convert an otherwise unstable board having no means of propulsion, to a stable, controllable, mobile platform upon which the operator can safely stand or sit and engage in activities such as fishing, sightseeing and other waterborne activities.

DESCRIPTION OF THE PREFERRED EMBODIMENT

Figure 1:
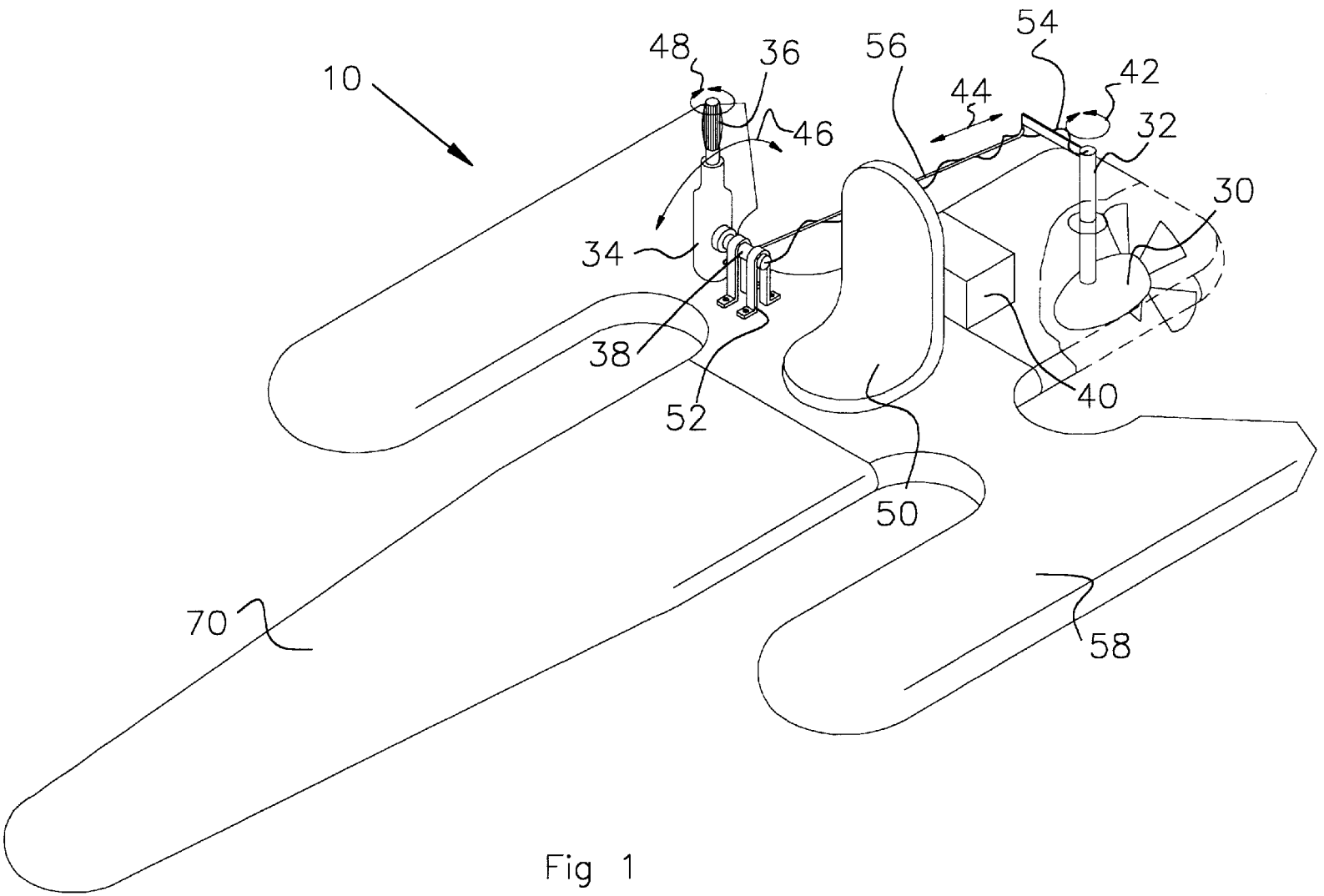
FIG. 1 is a perspective assembly view of a preferred embodiment of the present invention showing the modified trolling motor, seat arrangement and the pontoon floats mounted to a floatable board.

Referring now to the drawings wherein like numerals designate like and corresponding parts throughout the several views. In FIG. 1 the overall modular unit is designated by the numeral 10. Floating board 70 is mounted with pontoon unit 58 to which seat 50 is affixed. Trolling motor 30 attached to shaft 32 can be turned in the direction of arrows 42. Shaft 32 is attached to control rod 56 moving in the direction of arrows 44. Control rod 56 is moved by control unit 34 rotatably (in the direction of arrows 46) attached to shaft 38 mounted in brackets 52. Throttle/speed control 36 is rotatable in the direction of arrows 48 and controls motor 30 through electrical cable 54. Battery 40 is mounted behind seat 50.

Figure 2:
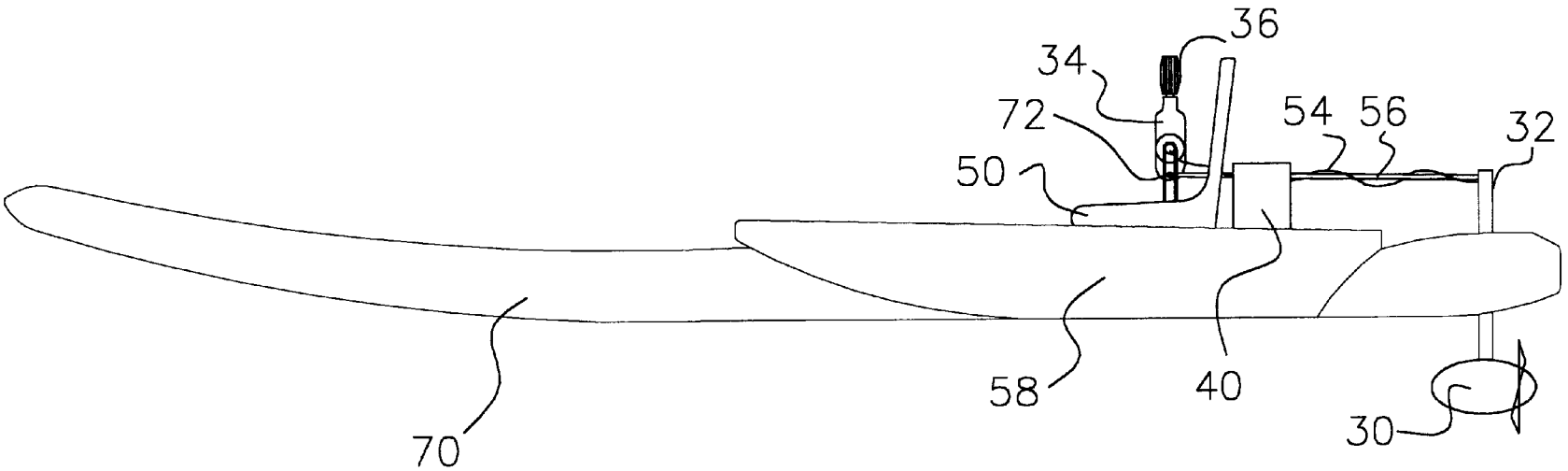
FIG. 2 is a side view of a floatable board to which the seat/pontoon unit is attached, showing the lower half of the trolling motor affixed pendently to the rear of the board.

In FIG. 2, pivot point 72 at the lower end of control unit 34 attaches to control rod 56 and to shaft 32. Motor 30 hangs beneath board 70. Battery 40 connects to cable 54.

Figure 3:
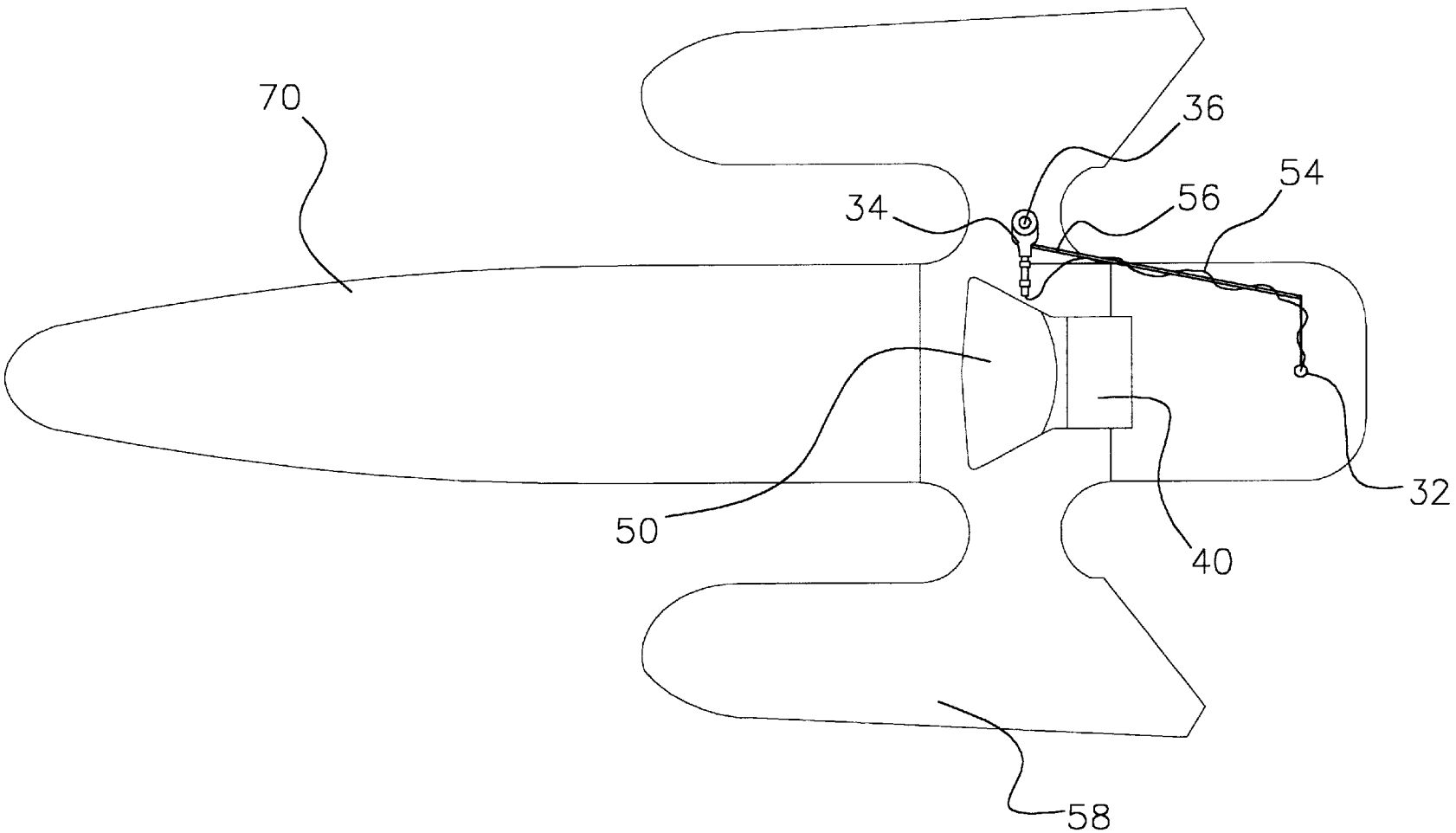
FIG. 3 is a top plan view of a floatable board to which the seat/pontoon unit is attached.

In FIG. 3, Control unit 34 located adjacent to seat 50 connects via connecting rod 56 to shaft 32. Board 70 supports pontoon unit 58.

Figure 4:
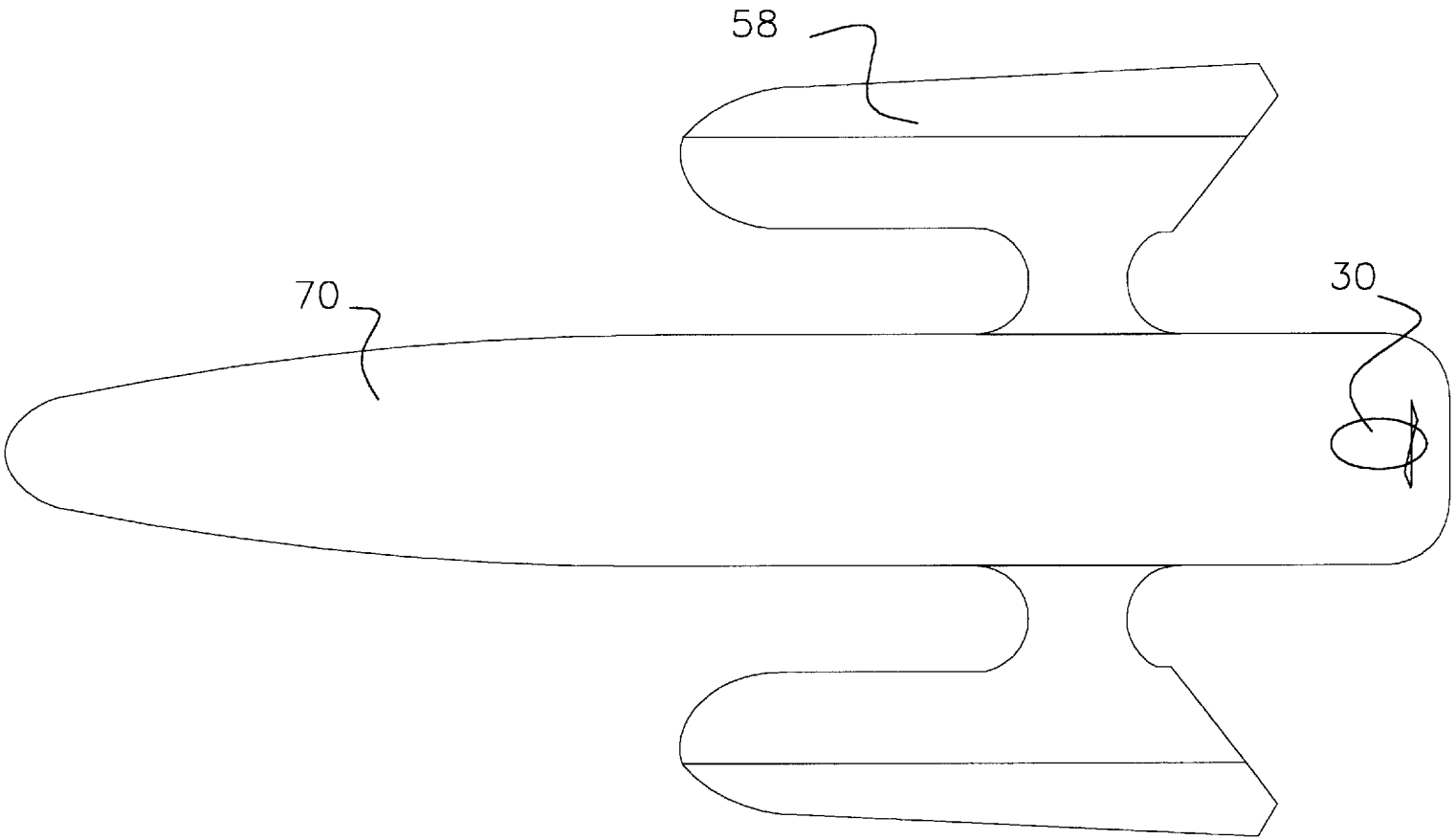
FIG. 4 is a bottom view showing the pontoon unit in place and the motor unit attached to the board.

In FIG. 4 motor 30 is affixed at the center rear of board 70.

What is claimed is:

1. A stabilization/power system for windsurfing and other flotation boards, said system comprising:

a floating board having a top surface, a front portion, rear portion, a first edge and a second edge, a stabilization assembly being removably attached to said top surface of said floating board in a position forward of said rear portion, said assembly having a pontoon unit formed thereon, said pontoon unit having a right pontoon and a left pontoon affixed at each of the opposite ends and extending outwardly of each of said edges of said floating board, a seat affixed to said stabilization assembly, a battery on said stabilization assembly, a modified trolling motor rotatably mounted by means of a trolling motor shaft in said rear portion of said floating board, said motor having the throttle/speed control unit removed from said trolling motor and an extension affixed to said trolling motor shaft in a position perpendicular to said shaft, a bracket mounted on said stabilization assembly in a position above said first edge, and said throttle/speed control unit rotatably mounted in said bracket, for varying the speed and direction of said trolling motor, said throttle/speed control unit having a pivot point formed therein and said control unit being electrically connected to said trolling motor and said pivot point being mechanically connected to said trolling motor through a mechanical linkage to said extension affixed to said trolling motor.

* * * * *